US008050576B2

(12) United States Patent
Yasukawa et al.

(10) Patent No.: US 8,050,576 B2
(45) Date of Patent: Nov. 1, 2011

(54) MANAGEMENT SYSTEM, MANAGEMENT DEVICE, MANAGEMENT METHOD AND COMPUTER READABLE MEDIUM

(75) Inventors: Kaoru Yasukawa, Ashigarakami-gun (JP); Masayasu Takano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/725,904

(22) Filed: Mar. 17, 2010

(65) Prior Publication Data

US 2011/0069977 A1 Mar. 24, 2011

(30) Foreign Application Priority Data

Sep. 18, 2009 (JP) ..... 2009-216704

(51) Int. Cl.
*G03G 15/08* (2006.01)

(52) U.S. Cl. ..... 399/27; 399/44; 399/262

(58) Field of Classification Search ..... 399/8, 9, 399/24, 27, 28, 38, 44, 61, 94, 97, 120, 255, 399/258, 262
See application file for complete search history.

(56) References Cited

U.S. PATENT DOCUMENTS

2003/0202806 A1* 10/2003 Katoh et al. ..... 399/27
2004/0158661 A1* 8/2004 Mokuya ..... 710/72

FOREIGN PATENT DOCUMENTS

JP A-08-166712 6/1996
JP A-11-174909 7/1999
JP A-2005-173088 6/2005
JP A-2006-259145 9/2006

* cited by examiner

*Primary Examiner* — David Porta
*Assistant Examiner* — Benjamin Schmitt
(74) *Attorney, Agent, or Firm* — Oliff & Berridge, PLC

(57) ABSTRACT

A management system includes: an image forming apparatus including a toner storage unit storing toner used in a developing unit, and a toner-transporting unit transporting the toner from the toner storage unit to the developing unit; and a management device connected to the apparatus through a communication unit, and managing a toner-remaining amount in the toner storage unit. The management device includes: an acquiring unit acquiring, from the apparatus, information on toner transportation time and characteristic quantities concerning variation in toner consumption in the developing unit and representing environment in the apparatus; a predicting unit calculating a predicted value of the toner-remaining amount with the acquired information on toner transportation time; a memory storing correspondence between the predicted value and a measured value of the toner-remaining amount; and a correcting unit correcting the correspondence according to the characteristic quantities, and correcting the predicted value with the corrected correspondence.

12 Claims, 9 Drawing Sheets

FIG.7A

| CHARACTERISTIC QUANTITY | CORRELATION COEFFICIENTS WITH X/Y (M) |
|---|---|
| ACCUMULATED PIXEL NUMBER | -0.5 |
| NUMBER OF PRINTS FOR EACH SHEET SIZE | -0.49 |
| NUMBER OF COLOR PRINTS FOR SHEET SIZE "W1" | -0.48 |
| AVERAGE HUMIDITY | -0.36 |
| NUMBER OF MONOCHROME PRINTS WITH PROCESS SPEED "S" | -0.32 |
| NUMBER OF COLOR PRINTS WITH PROCESS SPEED "S" | -0.29 |
| NUMBER OF DENSITY CORRECTION PROCESSING FOR TONER IMAGES OF EACH COLOR | -0.28 |
| AVERAGE TEMPERATURE | -0.27 |
| NUMBER OF COLOR PRINTS FOR SHEET SIZE "W2" | -0.25 |
| NUMBER OF COLOR PRINTS FOR SHEET SIZE "W3" | -0.16 |
| NUMBER OF MONOCHROME PRINTS FOR SHEET SIZE "W4" | -0.15 |
| AVERAGE IMAGE DENSITY ON SHEET | -0.14 |
| ... | ... |

FIG.7B

| CHARACTERISTIC QUANTITY | CORRELATION COEFFICIENTS WITH ACCUMULATED PIXEL NUMBER (M) |
|---|---|
| NUMBER OF PRINTS FOR EACH SHEET SIZE | 0.557 |
| NUMBER OF COLOR PRINTS FOR SHEET SIZE "W1" | 0.486 |
| AVERAGE HUMIDITY | -0.186 |
| NUMBER OF MONOCHROME PRINTS WITH PROCESS SPEED "S" | 0.300 |
| NUMBER OF COLOR PRINTS WITH PROCESS SPEED "S" | 0.443 |

MANAGEMENT SYSTEM, MANAGEMENT DEVICE, MANAGEMENT METHOD AND COMPUTER READABLE MEDIUM

CROSS REFERENCE TO RELATED APPLICATIONS

This application is based on and claims priority under 35 USC §119 from Japanese Patent Application No. 2009-216704 filed Sep. 18, 2009.

BACKGROUND

1. Technical Field

The present invention relates to a management system, a management device, a management method and a computer readable medium storing a program.

2. Related Art

There has been proposed a technique that predicts the remaining amount of toner in an image forming apparatus such as a copy machine and a printer.

SUMMARY

According to an aspect of the present invention, there is provided a management system including: an image forming apparatus including: a developing unit that develops, with toner, an electrostatic latent image formed on an image carrier; a toner storage unit that stores the toner used in the developing unit; and a toner-transporting unit that transports the toner from the toner storage unit to the developing unit; and a management device that is connected to the image forming apparatus through a communication unit, and that manages a remaining amount of toner in the toner storage unit provided in the image forming apparatus. The management device includes: an acquiring unit that acquires, from the image forming apparatus, information on transportation time of the toner by the toner-transporting unit, information on a characteristic quantity with regard to variation in toner consumption in the developing unit, and information on a characteristic quantity representing environment in the image forming apparatus; a predicting unit that calculates a predicted value of the remaining amount of toner in the toner storage unit with the information on the transportation time of the toner acquired by the acquiring unit; a memory that stores a correspondence relationship between the predicted value calculated by the predicting unit and a measured value of the remaining amount of toner in the toner storage unit; and a correcting unit that corrects the correspondence relationship stored in the memory according to the characteristic quantity with regard to variation in toner consumption and the characteristic quantity representing environment, which quantities are indicated by the information acquired by the acquiring unit, and that corrects, with the correspondence relationship having been corrected, the predicted value calculated by the predicting unit.

BRIEF DESCRIPTION OF THE DRAWINGS

Exemplary embodiment(s) of the present invention will be described in detail based on the following figures, wherein:

FIGS. 7A and 7B are tables showing correlation coefficients between X/Y and characteristic quantity that are supposed to have a correlation with X/Y;

DETAILED DESCRIPTION

<Description of Management System>

An exemplary embodiment of the present invention will be described below in detail with reference to the accompanying drawings.

Figure 1:
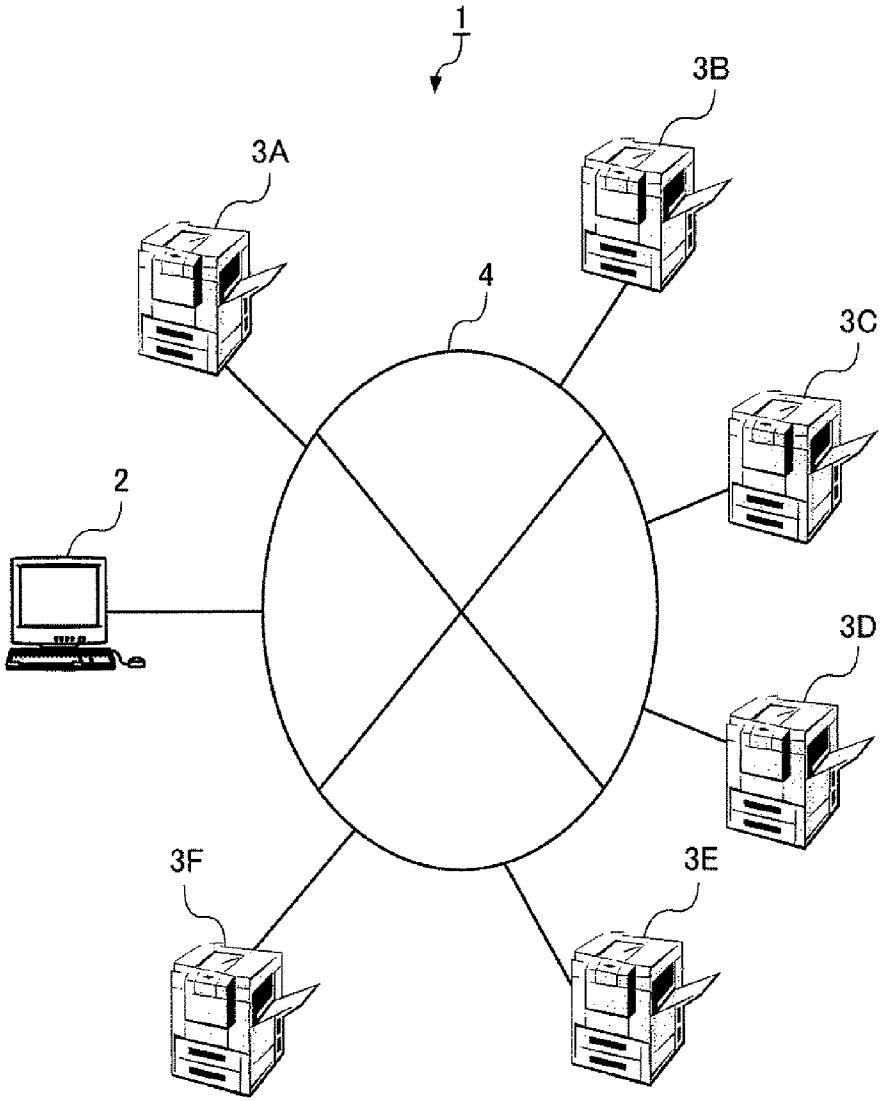
FIG. 1 is a schematic view showing an entire configuration of a management system according to the exemplary embodiment.

FIG. 1 is a schematic view showing an entire configuration of a management system 1 according to the exemplary embodiment. In the management system 1 shown in FIG. 1, multiple image forming apparatuses 3A to 3F (hereinafter, "image forming apparatuses 3") equipping, for example, a copying function, a printing function and the like, and a management server 2 as an example of a management device that manages the remaining amounts of toner in the image forming apparatuses 3 are connected via a network 4 as an example of a communication unit so as to be communicable with each other. As the network 4, for example, a Local Area Network (LAN), a Wide Area Network (WAN), the Internet or the like is used.

The management system 1 shown in FIG. 1 illustrates a configuration in which six image forming apparatuses 3A to 3F are connected to the network 4 as an example. However, there may be a configuration in which only one image forming apparatus 3 is connected to the network 4, or in which a large number, for example a hundred or more, of image forming apparatuses 3 are connected to the network 4. Furthermore, not only the image forming apparatuses 3 but also a personal computer (PC), for example, that transmits an image forming command (print job) to the image forming apparatuses 3 may be connected to the network 4 in some cases. The communication line constituting the network 4 may include a telephone line and a satellite communication line (for example, spatial transmission line in digital satellite broadcasting).

<Description of Image Forming Apparatus>

Figure 2:
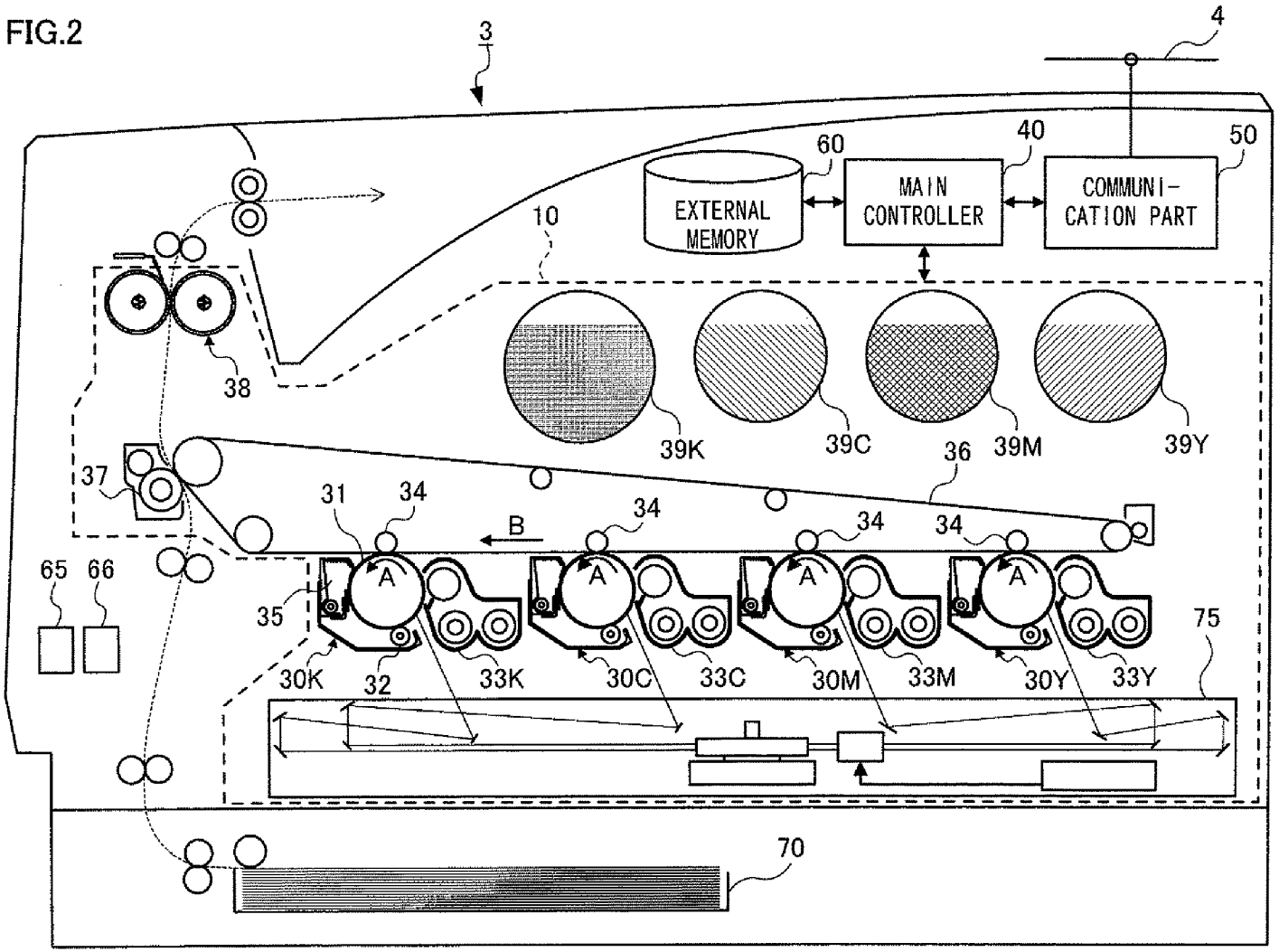
FIG. 2 is a diagram in which a configuration of the image forming apparatus is exemplified.

Next FIG. 2 is a diagram in which a configuration of the image forming apparatus 3 connected to the management system 1 according to the exemplary embodiment is exemplified. The image forming apparatus 3 shown in FIG. 2 is an image forming apparatus of an electrophotographic type equipping, for example, a copying function, a printing function and the like. The image forming apparatus 3 includes: an image forming part 10 that forms a color image on a recording medium (sheet) on the basis of image data; a main controller 40 that controls operations of the entire image forming apparatus 3; and a communication part 50 as an example of a transmitting unit that is connected to the network 4 and that communicates with, for example, the management server 2 (see FIG. 1), a PC (not shown) and the like. The image forming apparatus 3 also includes: an external memory 60 that is implemented by, for example, a hard disk drive (HDD) in which a processing program and the like are stored; a humidity sensor 65 as an example of a humidity detecting unit that detects humidity in the apparatus, and a temperature sensor 66 that detects temperature in the apparatus.

The image forming part 10 includes four image forming units 30Y, 30M, 30C and 30K (hereinafter, "image forming units 30") that are arranged in parallel at regular intervals and that form toner images of yellow (Y), magenta (M), cyan (C) and black (K), respectively.

Each of the image forming units 30 includes: a photoconductive drum 31 that obtains an electrostatic latent image formed thereon while rotating in the direction of an arrow A; a charging device 32 that charges the surface of the photoconductive drum 31; a developing device 33Y, 33M, 33C or 33K, (hereinafter, "developing device 33"), as an example of a developing unit that develops an electrostatic latent image formed on the photoconductive drum 31; and a drum cleaner 35 that cleans the surface of the photoconductive drum 31 after a primary transfer.

Each of the developing devices 33 holds a developer composed of toner of the corresponding color and magnetic carriers, and develops an electrostatic latent image formed on the photoconductive drum 31. Each of the developing devices 33 is connected through a toner transportation path (see FIG. 3 described later) to a toner container 39Y, 39M, 39C or 39K (hereinafter, "toner container 39"), as an example of a toner storage unit that stores toner of the corresponding color. Each of the developing devices 33 is configured to be supplied with the toner from the toner container 39 by a supply screw (see FIG. 3 described later) provided in the toner transportation path.

The developing device 33 also detects a blend ratio (toner density) between the toner and the magnetic carriers in the developer by detecting, for example, a change in the magnetic permeability of the developer, and sends the detection value (hereinafter, "toner density detection value") to the main controller 40. The main controller 40 controls operation of the supply screw in the toner transportation path on the basis of the acquired toner density detection value. With this control, the main controller 40 adjusts the amounts of the color toners supplied respectively from the toner containers 39Y, 39M, 39C and 39K to the inside of the respective developing devices 33, thereby to control the toner density inside the developing devices 33.

On this occasion, the main controller 40 determines that the remaining amount of toner in the toner container 39 connected to the developing device 33 is nearly "0," if the toner density detection value does not exceed a predetermined specified value even though the main controller 40 controls the toner density inside the developing device 33.

In such an image forming apparatus 3, the main controller 40 executes image processing for read image signals read by, for example, an image reading unit (not shown) and print commands acquired from a PC or the like via the communication part 50. Specifically, the main controller 40 executes various types of image processing, such as a rendering process, a color conversion process, a screening process and the like, for image data included in the read image signals and the print commands. Thereby, for each color component, the main controller 40 generates binary image data (1-bit image data) spuriously representing the density of a halftone image by using colored dots, called halftone dots, each having a corresponding size. Then, the main controller 40 outputs the generated binary image data to an exposure device 75.

A unit of an image part formed of the generated binary image data is referred to as "pixel," while the number of pixels composing the image part is referred to as "pixel number." For example, the pixel number for a 5 mm times 5 mm image part with resolution of 2400 dots per inch (dpi) is $(2400/25.4)\times5\times5=2362$ pixels.

The exposure device 75 emits, for example, a laser beam according to image data (binary image data) for each color component, thereby to scan and expose the photoconductive drums 31 of the image forming units 30. Then, for example, in the image forming unit 30K forming a black-color (K) toner image, the photoconductive drum 31, which is charged by the charging device 32 while rotating in the direction of the arrow A, is scanned and exposed by the exposure device 75. Thereby, an electrostatic latent image of the black-color image is formed on the photoconductive drum 31. The black-color electrostatic latent image formed on the photoconductive drum 31 is developed by the developing device 33K. The black-color toner image is then formed on the photoconductive drum 31. In the same manner, yellow (Y), magenta (M) and cyan (C) color toner images are formed in the image forming units 30Y, 30M and 30C, respectively.

The color toner images formed on the respective photoconductive drums 31 in the image forming units 30 are electrostatically transferred (primarily transferred) in sequence, by the primary transfer rolls 34, onto an intermediate transfer belt 36 that moves in the direction of an arrow B. This forms superimposed toner images on which the color toners are superimposed on one another. The superimposed toner images on the intermediate transfer belt 36 are transported to a region at which a secondary transfer roll 37 is arranged, along with the movement of the intermediate transfer belt 36. Then, the superimposed toner images are collectively and electrostatically transferred (secondarily transferred) by the secondary transfer roll 37 onto the sheet transported from a sheet-supplying unit 70.

Thereafter, the sheet onto which the superimposed toner images are electrostatically transferred is transported to a fixing device 38. The superimposed toner images are then fixed onto the sheet. Meanwhile, the toner (primary-transfer residual toner) attached to the photoconductive drums 31 after the primary transfer is removed by the drum cleaners 35.

In this way, the image formation processing in the image forming apparatus 3 is repeatedly performed for a designated number of print sheets.

<Description of Toner Supply Mechanism to Developing Devices>

Next, a description will be given of toner supply from the respective toner containers 39 that store toner of the corresponding colors to the respective developing devices 33.

Figure 3:
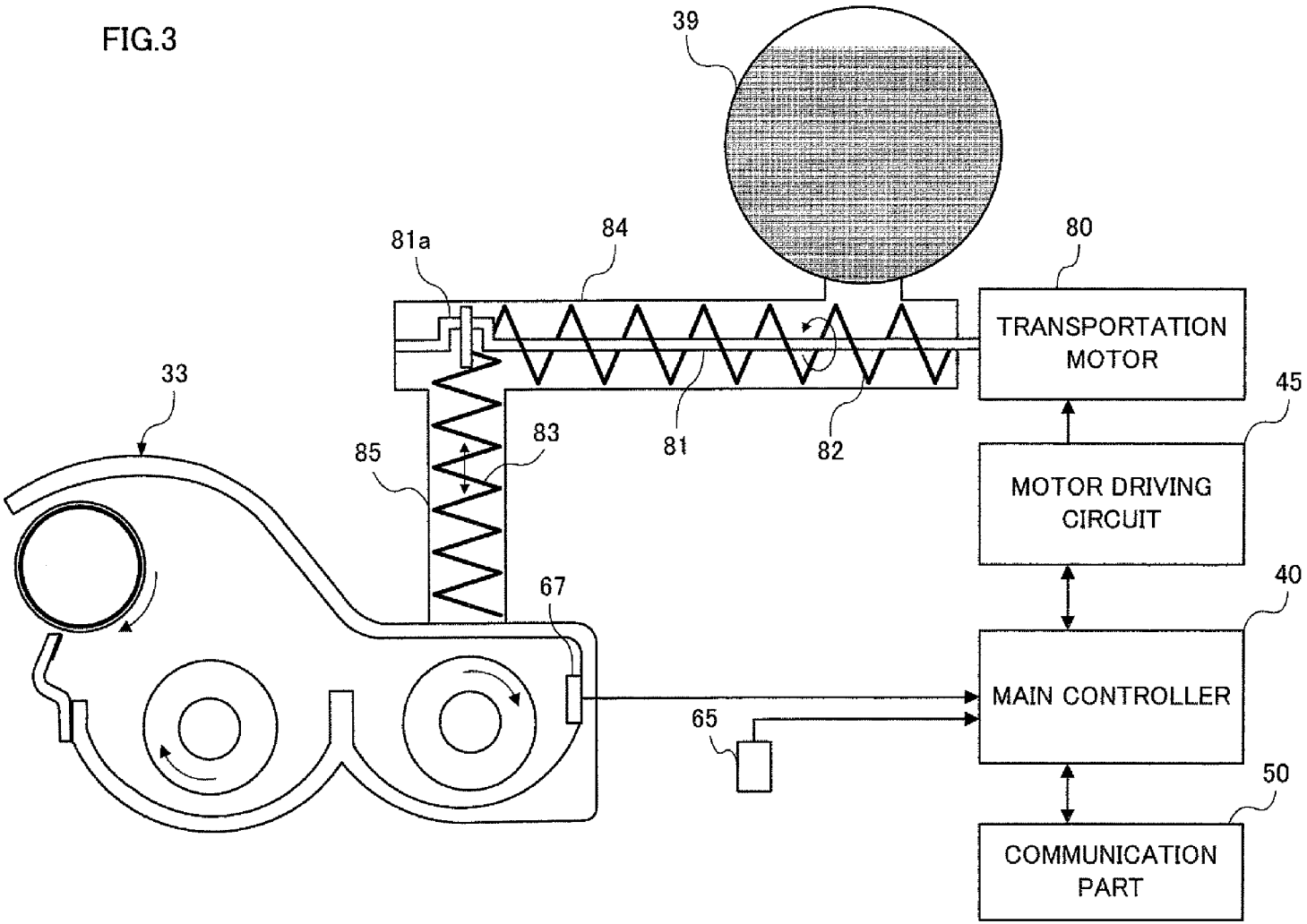
FIG. 3 is a diagram illustrating a toner supply mechanism that transports toner from the toner containers to the respective developing devices.

FIG. 3 is a diagram illustrating a toner supply mechanism as an example of a toner-transporting unit that transports toner from the respective toner containers 39 to the respective developing devices 33. As shown in FIG. 3, each of the toner containers 39 is connected to the corresponding developing device 33 with a first toner transportation path 84 through which toner is transported in the lateral direction in the figure (for example, the horizontal direction in the image forming apparatus 3) and a second toner transportation path 85 that is connected to the first toner transportation path 84 and through which toner is transported in the longitudinal direction in the figure (for example, the vertical direction in the image forming apparatus 3).

Inside the first toner transportation path 84, there are arranged a rotation axis 81 connected to a transportation motor 80, and a first supply screw 82 integrally coupled with the rotation axis 81. The rotation of the rotation axis 81 and the first supply screw 82 by the transportation motor 80 transports the toner contained in the toner container 39 to the developing device 33 side along the first toner transportation path 84.

Additionally, inside the second toner transportation path 85, there is arranged a second supply screw 83 that is connected to a clamp mechanism 81*a* formed at the end portion of the rotation axis 81 inside the first toner transportation path 84. The second supply screw 83 moves upward and downward in response to the up-and-down movement of the clamp mechanism 81*a* caused by the rotation of the rotation axis 81, thereby to transport, to the developing device 33 side, the toner having been transported along the first toner transportation path 84 by the first supply screw 82.

The operations of the transportation motor 80 that rotates the rotation axis 81 and the first supply screw 82 in the first toner transportation path 84 are controlled by a motor driving circuit 45. Meanwhile, inside the developing device 33, there is arranged a toner density sensor 67 that detects a blend ratio (toner density) between the toner and the magnetic carriers in the developer by detecting, for example, a change in the magnetic permeability of the developer. The detection value (toner density detection value) is sent to the main controller 40. The main controller 40 generates a control signal according to the toner density detection value acquired from the toner density sensor 67, and outputs the generated control signal to the motor driving circuit 45. Thereby, the motor driving circuit 45 controls the rotation of the rotation axis 81 and the first supply screw 82 in the first toner transportation path 84, and adjusts the amount of each color toner supplied from the toner container 39 to the inside of the developing devices 33, thereby to control the toner density inside the developing devices 33.

The motor driving circuit 45 also sends, to the main controller 40, information (toner transportation time information) on the time (toner transportation time) during which the toner is transported for every toner supply operation, when operating the transportation motor 80 according to the control signal acquired from the main controller 40. Thereby, the main controller 40 accumulates the toner transportation time by use of the toner transportation time information acquired from the motor driving circuit 45, and obtains "accumulated toner transportation time" that is an accumulated value of the toner transportation time from the replacement of each toner container 39 to supply toner, for example. The main controller 40 transmits information on an estimate value of the remaining amount of toner (hereinafter, "estimate value information on the remaining amount of toner") in each toner container 39, which information is an example of information on the toner transportation time, from the communication part 50 to the management server 2 via the network 4, every time when the "accumulated toner transportation time" exceeds a predetermined threshold value.

Specifically, in the main controller 40, there are prestored, for example, a 75% toner transportation time threshold value for assumption of the arrival of the remaining amount of toner in each toner container 39 to 75%, a 50% toner transportation time threshold value for assumption of the arrival of the remaining amount of toner to 50%, and a 25% toner transportation time threshold value for assumption of the arrival of the remaining amount of toner to 25%. The main controller 40 informs the management server 2 of information that the remaining amount of toner in the corresponding toner container 39 is assumed to be "75%," "50%" and "25%" as "estimate value information on the remaining amount of toner," at time points when the accumulated toner transportation time obtained by calculation exceeds the 75% toner transportation time threshold value, the 50% toner transportation time threshold value, and the 25% toner transportation time threshold value, respectively.

The main controller 40 determines that the remaining amount of toner contained inside the toner container 39 corresponding to the developing device 33 is nearly "0" ("empty"), if the toner density detection value detected by the toner density sensor 67 inside the developing device 33 is lower than the predetermined specified value even though the main controller 40 performs the toner density control as mentioned above. The main controller 40 transmits a "toner empty warning" that warns of lack of toner, from the communication part 50 to the management server 2 via the network 4, if determining that the toner in the toner container 39 has nearly run out.

Furthermore, the main controller 40 measures the number of pixels (pixel number) composing the image part when performing image processing on the image data to generate the binary image data. The main controller 40 then accumulates the pixel number for each color component, and calculates, for example, accumulated pixel number from the replacement of each toner container 39 (toner supply time), as an example of a characteristic quantity with regard to variation in toner consumption. The main controller 40 further transmits information on the accumulated pixel number (hereinafter, "accumulated pixel number information"), as an example of information on the characteristic quantity with regard to variation in toner consumption, as well as the "estimate value information on the remaining amount of toner," from the communication part 50 to the management server 2 via the network 4, at a time point when the management server 2 is informed of the "estimate value information on the remaining amount of toner."

Furthermore, the main controller 40 acquires a detection value of humidity (humidity detection value) in the apparatus detected by the humidity sensor 65. The main controller 40 weights each humidity detection value at image formation with the number of sheets on which the image formation has been performed or the like, and calculates average humidity at daily intervals, as an example of a characteristic quantity representing the environment in the image forming apparatus 3. Additionally, the main controller 40 transmits information on the average humidity (hereinafter, "average humidity information"), as an example of information on the characteristic quantity representing the environment in the image forming apparatus 3, as well as the "estimate value information on the remaining amount of toner" and the "accumulated pixel number information," from the communication part 50 to the management server 2 via the network 4, at the time point when the management server 2 is informed of the "estimate value information on the remaining amount of toner."

Note that the main controller 40 herein serves as an average humidity calculation unit.

As described above, the image forming apparatuses 3 according to the present exemplary embodiment obtain the "accumulated toner transportation time" that is an accumulated value of the toner transportation time, while controlling the toner density inside the developing devices 33. The image forming apparatuses 3 transmits the "estimate value information on the remaining amount of toner," the "accumulated pixel number information" and the "average humidity information" to the management server 2, every time when the "accumulated toner transportation time" exceeds a predetermined threshold value.

It is when the accumulated toner transportation time exceeds the 75% toner transportation time threshold value, the 50% toner transportation time threshold value, and the 25% toner transportation time threshold value, respectively, for each of the toner containers 39Y, 39M, 39C and 39K provided in the image forming apparatus 3 that the management server 2 is informed of the above-mentioned "estimate value information on the remaining amount of toner." The management server 2 is informed of the individual "estimate value information on the remaining amount of toner" for each of the toner containers 39Y, 39M, 39C and 39K.

<Description of Management Server>

Next, a description will be given of the management server 2 that manages the remaining amount of toner in the image forming apparatuses 3 connected to the network 4.

Figure 4:
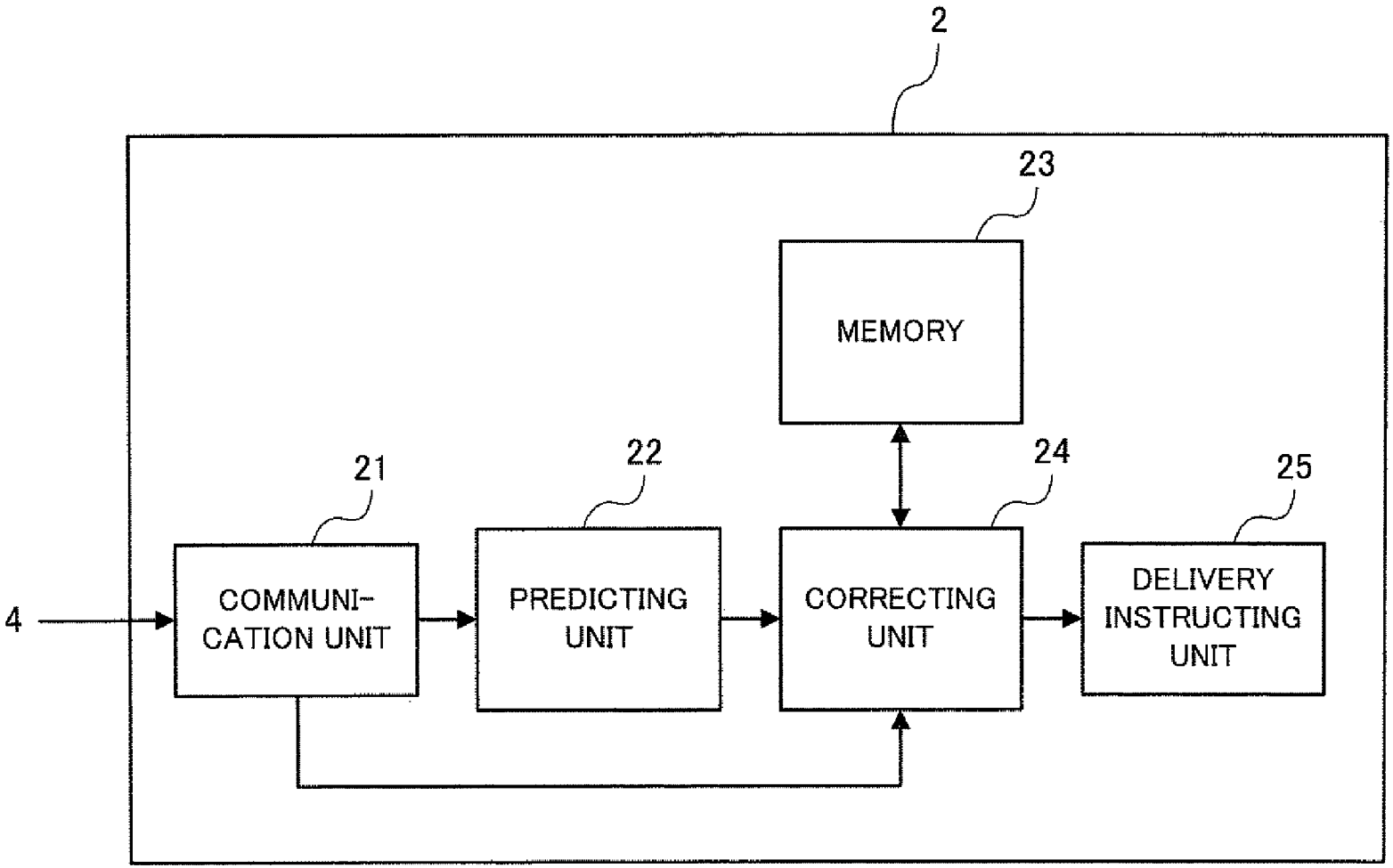
FIG. 4 is a diagram illustrating a configuration of a functional part in the management server, which part manages the remaining amount of toner in the image forming apparatuses.

FIG. 4 is a diagram illustrating a configuration of a functional part in the management server 2, which part manages the remaining amount of toner in the image forming apparatuses 3. As shown in FIG. 4, as the functional part that manages the remaining amount of toner in the image forming apparatuses 3, the management server 2 includes a communication unit 21 and a predicting unit 22. The communication unit 21 is an example of an acquiring unit that is connected to the network 4 and that communicates with the image forming apparatuses 3. The predicting unit 22 is an example of a predicting unit that predicts a due date (hereinafter, "toner empty predicted day") on which the remaining amount of toner in the image forming apparatuses 3 becomes "0," on the basis of the "estimate value information on the remaining amount of toner" acquired from the image forming apparatuses 3.

Additionally, the management server 2 includes a memory 23, a correcting unit 24 and a delivery instructing unit 25. The memory 23 is an example of a memory that stores, for example, a correspondence relationship between the "toner empty predicted day" (predicted value) predicted by the predicting unit 22 and the time (measured value) when the remaining amount of toner in the toner container 39 actually becomes "0" (hereinafter, "correspondence relationship between a predicted value and a measured value"). The correcting unit 24 is an example of a correcting unit that corrects the "toner empty predicted day" predicted by the predicting unit 22, on the basis of the "correspondence relationship between a predicted value and a measured value" stored in the memory 23, and the "accumulated pixel number information" and the "average humidity information" acquired from each of the image forming apparatuses 3. The delivery instructing unit 25 outputs instructing information to the department in charge (person in charge of delivery) so that the department arranges the delivery of toner (a new toner container 39) to the corresponding image forming apparatus 3 by the "toner empty predicted day" corrected by the correcting unit 24 (hereinafter, "corrected toner empty predicted day").

The communication unit 21 acquires the "estimate value information on the remaining amount of toner," the "accumulated pixel number information" and the "average humidity information" from each of the image forming apparatuses 3, at time points when the remaining amount of toner in each of the toner containers 39 in the image forming apparatus 3 connected to the network 4 is assumed to be "75%," "50%" and "25%," respectively.

The predicting unit 22 predicts the "toner empty predicted day" by use of the "estimate value information on the remaining amount of toner" acquired by the communication unit 21 from each of the image forming apparatuses 3, on the basis of the accumulated toner transportation time in each of the image forming apparatuses 3. Specifically, the predicting unit 22 predicts the "toner empty predicted day" according to the time of acquisition of the "estimate value information on the remaining amount of toner" indicating that the remaining amount of toner is "50%" and "25%."

The correcting unit 24 corrects the "correspondence relationship between a predicted value and a measured value" stored in the memory 23 by use of the "average humidity information" and the "accumulated pixel number information," which are acquired from each of the image forming apparatuses 3 as well as the "estimate value information on the remaining amount of toner." Then, by use of the corrected "correspondence relationship between a predicted value and a measured value," the correcting unit 24 corrects the "toner empty predicted day" predicted by the predicting unit 22 on the basis of the accumulated toner transportation time.

The "correspondence relationship between a predicted value and a measured value" stored in the memory 23 will be described later in detail.

<Description Concerning Correction of "Toner Empty Predicted Day">

Figure 5:
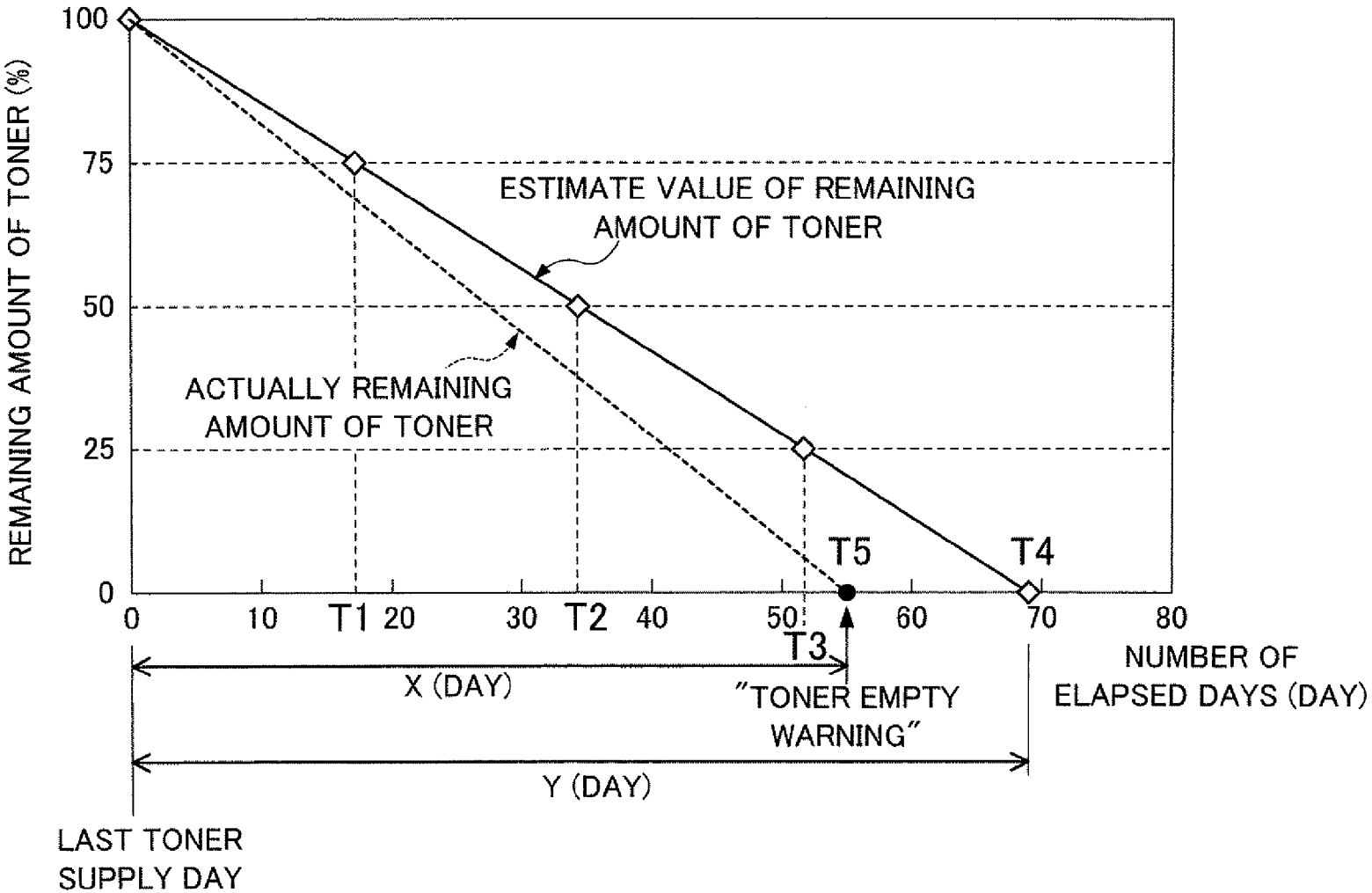
FIG. 5 is a graph illustrating the reason why the correcting unit corrects the "toner empty predicted day" predicted by the predicting unit.

Next, FIG. 5 is a graph illustrating the reason why the correcting unit 24 corrects the "toner empty predicted day" predicted by the predicting unit 22.

As described above, the management server 2 acquires the "estimate value information on the remaining amount of toner" based on the accumulated toner transportation time from each of the image forming apparatuses 3, at time points (T1, T2 and T3 in FIG. 5) when the remaining amount of toner in each of the toner containers 39 in the image forming apparatus 3 is assumed to be "75%," "50%" and "25%," respectively. Thereby, the predicting unit 22 in the management server 2 assumes that the remaining amount of toner in the toner containers 39 corresponding to the "estimate value information on the remaining amount of toner" is "75%" at the time point T1, "50%" at the time point T2 and "25%" at the time point T3. At the time point T3 when the predicting unit 22 acquires the "estimate value information on the remaining amount of toner" indicating that the accumulated toner transportation time exceeds the 25% toner transportation time threshold value, the predicting unit 22 obtains the "toner empty predicted day" with a linear approximation according to the intersection point between the straight line connecting the time points T2 and T3, at which the remaining amount of toner is assumed to be "50%" and "25%," respectively, and the coordinate axis representing the number of elapsed days. Thereby, the predicting unit 22 predicts that the "toner empty predicted day" on which the remaining amount of toner will become "0" is the Y-th day (T4 in FIG. 5) from the day of the last replacement of the toner containers 39 ("last toner supply day"), for example.

Incidentally, the "estimate value information on the remaining amount of toner" that the management server 2 has acquired from the image forming apparatuses 3 is generated on the basis of the accumulated toner transportation time during which the toner is transported from each of the toner containers 39 by the transportation motor 80. However, the relationship between the drive time of the transportation motor 80 transporting the toner and the amount of the actually transported toner is not always constant. For example, the relationship between the drive time of the transportation motor 80 and the amount of toner actually transported by the first supply screw 82 and the second supply screw 83 differs between a case where the transportation motor 80 is subjected to repeated drives each of which has short drive time while a great number of images with small toner consumption are printed out, and a case where the transportation motor 80 is subjected to repeated drives each of which has long drive time while a great number of images with large toner consumption are printed out. It is conceivable that such a difference occurs because of a mechanical factor, a factor concerning toner properties and the like. A mechanical factor is, for example, that there is a difference in time (a time lag) from the transmission of the drive signal to the transportation motor 80 to the actual start of the transportation motor 80. A factor concerning toner properties is, for example, that the amount of the actually transported toner differs even though the drive time of the transportation motor 80 is constant, since the viscosity and fluidity of toner varies depending on humidity and the like in the apparatus.

As a result, in each of the image forming apparatuses 3 according to the present exemplary embodiment, the respective time points of notification of the "estimate value information on the remaining amount of toner" indicating that the remaining amount of toner is assumed to be "75%," "50%" and "25%" appear later than the respective time points when the remaining amount of toner actually becomes "75%," "50%" and "25%," as shown in FIG. 5.

For example, the time point T5 when the main controller 40 of each image forming apparatus 3 informs the management server 2 of the "toner empty warning" according to the toner density detection value detected by the toner density sensor 67 is before the Y-th day (T4 in FIG. 5) predicted by predicting unit 22, and is the X-th day from the last toner supply day.

In this case, the late appearance of the time points of notification of the "estimate value information on the remaining amount of toner" as compared to the respective time points for the actually remaining amount of toner results from the 75% toner transportation time threshold value, the 50% toner transportation time threshold value, and the 25% toner transportation time threshold value stored in the main controller 40 of the present exemplary embodiment. That is, if the main controller 40 stores the 75% toner transportation time threshold value, the 50% toner transportation time threshold value, and the 25% toner transportation time threshold value, as different definite values, the time points of notification of the "estimate value information on the remaining amount of toner" may be earlier than the respective time points for the actually remaining amount of toner, in some cases. However, because of the above-mentioned factors, it is difficult to approximate, with only the definite values of these threshold values, the "toner empty predicted day" (Y days) to X days on which the management server 2 is informed of the "toner empty warning," while the "toner empty predicted day" is adjusted to various conditions concerning each image forming apparatus 3.

Thus, in the management server 2 according to the present exemplary embodiment, the correcting unit 24 corrects the "toner empty predicted day" predicted by the predicting unit 22 by use of the "correspondence relationship between a predicted value and a measured value" stored in the memory 23, and the "average humidity information" and the "accumulated pixel number information," which are acquired from each of the image forming apparatuses 3 as well as the "estimate value information on the remaining amount of toner."

<Description of Correction Formula for Correcting "Toner Empty Predicted Day">

The present exemplary embodiment uses a number of (for example, 100 or more) image forming apparatuses 3 working in the market, as sampling objects. The management server 2 collects data on the "toner empty predicted day" (Y days from the last toner supply day) actually predicted by the predicting unit 22 and data on the time (X days from the last toner supply day) of the actual replacement of the toner containers 39 in response to the "toner empty warning." The management server 2 then calculates the ratio (X/Y) with regard to the data on the time (X days) of the actual replacement of the toner containers 39 and the data on the "toner empty predicted day" (Y days) thus collected.

Figure 6:
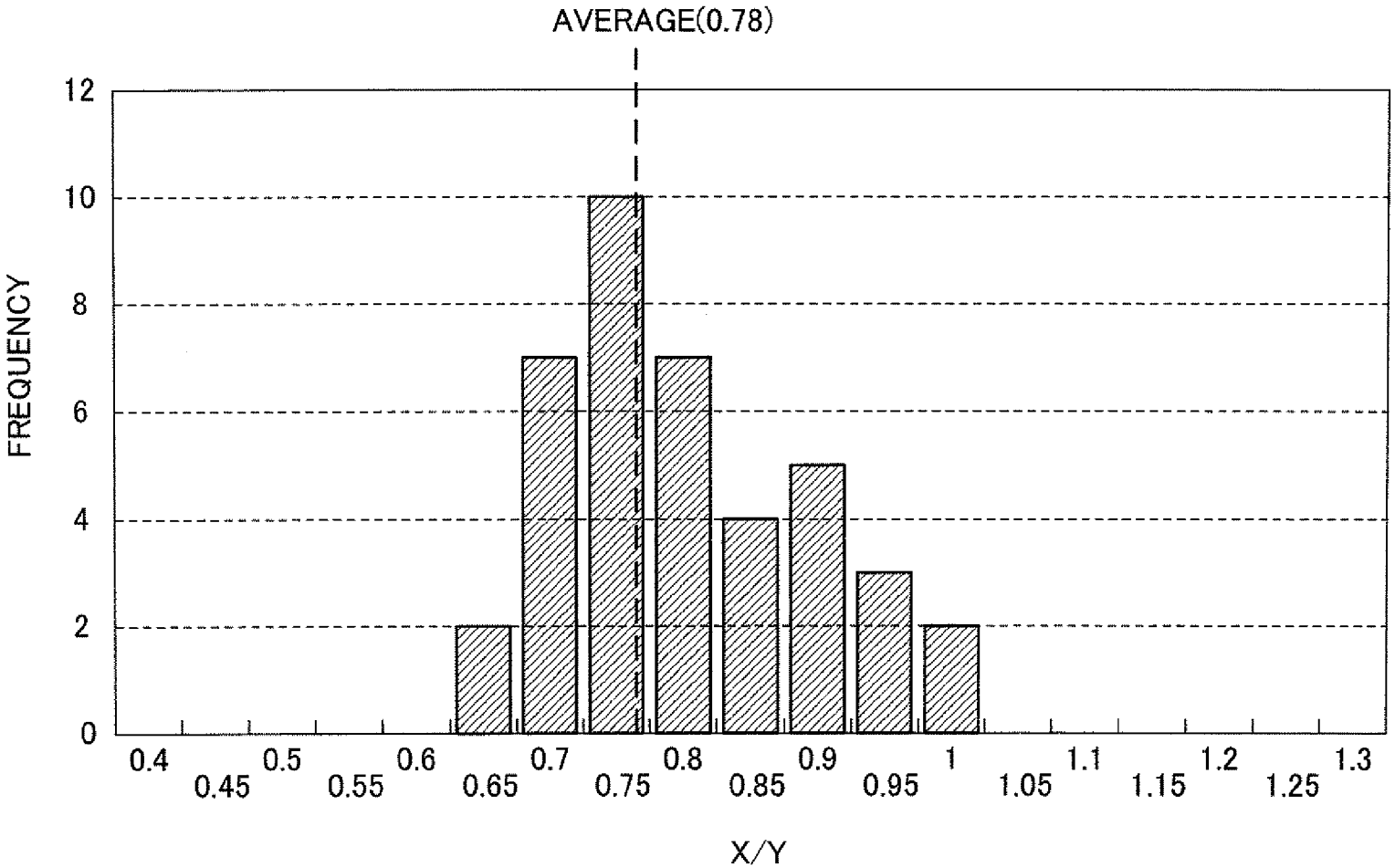
FIG. 6 is a graph showing an example of frequency distribution (histogram) of X/Y values concerning the image forming apparatuses as the sampling objects.

FIG. 6 is a graph showing an example of frequency distribution (histogram) of X/Y values concerning the image forming apparatuses 3 as the sampling objects. The average of X/Y is obtained as 0.78 in the case of the histogram shown in FIG. 6. That is, multiplying, by 0.78, the "toner empty predicted day" (Y days in FIG. 5) obtained by using the "estimate value information on the remaining amount of toner" based on the accumulated toner transportation time by the transportation motor 80 in each image forming apparatus 3 gives the average date of due dates by which the toner containers 39 will actually be replaced.

The management server 2 according to the present exemplary embodiment stores the average of X/Y (0.78 in the example of FIG. 6), in the memory 23, as the "correspondence relationship between a predicted value and a measured value" that is information indicating the correspondence relationship between the "toner empty predicted day" (predicted value) predicted by the predicting unit 22 and the time (measured value) when the remaining amount of toner in the toner containers 39 actually becomes "0."

Thereby, the "correspondence relationship between a predicted value and a measured value" as each of actual values for a number of image forming apparatuses 3 working in the market is stored in the memory 23, in advance. Thus, even for an image forming apparatus 3 that has not been used yet and is newly installed in the market, the prediction accuracy of the remaining amount of toner is improved by using the "correspondence relationship between a predicted value and a measured value" stored in the memory 23.

On the other hand, it is found from the histogram of FIG. 6 that the X/Y values disperse in a certain range around the average (0.78). Thus, even though the due date obtained by multiplying the "toner empty predicted day" by 0.78 is regarded as the actual "toner empty predicted day," there will be a considerable number of image forming apparatuses 3 having a "toner empty predicted day" different from the average.

Accordingly, in the present exemplary embodiment, there are performed: a search of a characteristic quantity having a high correlation with the X/Y values; and a correction (weighted) process to the average (0.78) for each image forming apparatus 3 by use of the characteristic quantity having a high correlation with the X/Y values.

FIGS. 7A and 7B are tables showing correlation coefficients between X/Y and characteristic quantities that are supposed to have a correlation with X/Y.

Each of the correlation coefficients M shown in FIGS. 7A and 7B is a statistical index indicating degrees of similarity between two characteristic quantities. Each of the correlation coefficients M is calculated by use of the following expression (1), for example. If a correlation coefficient M calculated by use of the following expression (1) is close to "1," the two characteristic quantities have a positive correlation. On the contrary, if a correlation coefficient M is close to "−1," the two characteristic quantities have a negative correlation. Meanwhile, if a correlation coefficient M is close to "0," the two characteristic quantities have a low correlation. The expression (2) formulates that Aave and Bave in the expression (1) are arithmetic mean values with regard to characteristic quantities $A_i$ and $B_i$, respectively.

$$M = \frac{\sum_{i=1}^{n}(A_i - Aave)(B_i - Bave)}{\sqrt{\sum_{i=1}^{n}(A_i - Aave)^2}\sqrt{\sum_{i=1}^{n}(B_i - Bave)^2}} \quad (1)$$

$$Aave = \frac{\sum_{i=1}^{n} A_i}{n},\ Bave = \frac{\sum_{i=1}^{n} B_i}{n} \quad (2)$$

In the expressions (1) and (2), $A_i$ represents the "X/Y value" for the image forming apparatus 3 of the i-th sampling number, while $B_i$ represents a measured value with regard to the "characteristic quantity that are supposed to have a correlation with X/Y" (characteristic quantity listed in the left column of FIG. 7A) for the image forming apparatus 3 of the i-th sampling number. Also, n represents the total number of the sampled image forming apparatuses 3.

Characteristic quantities affecting the toner consumption (characteristic quantity with regard to variation in toner consumption) in the image forming apparatuses 3 are selected as those which are supposed to have a correlation with X/Y shown in FIG. 7A, in the light of the purpose of predicting the remaining amount of toner. The six characteristic quantities whose correlation coefficients M are the closest to "1" or "−1," namely, "accumulated pixel number," "number of prints for each sheet size," "number of color prints for sheet size 'W1'," "average humidity," "number of monochrome prints with process speed 'S'" and "number of color prints with process speed 'S'" are extracted on the basis of the result shown in FIG. 7A, as those which have a high correlation among the "characteristic quantities that are supposed to have a correlation with X/Y."

The sheet size 'W1' represents a specific sheet size used in the image forming apparatus 3, while the process speed 'S' represents a specific process speed set for the image forming apparatus 3.

Moreover, with regard to the six extracted characteristic quantities, the correlation coefficients M between the "accumulated pixel number," which is a characteristic quantity having the highest correlation with X/Y, and the other characteristic quantities are calculated by use of the above-mentioned expression (1), for example. The calculation result is shown in FIG. 7B.

With reference to FIG. 7B, it is found that the correlation coefficients M between the "accumulated pixel number" and the "number of prints for each sheet size," the "number of color prints for sheet size 'W1'," the "number of monochrome prints with process speed 'S'" and the "number of color prints with process speed 'S'" are relatively close to "1," which indicates high correlations with each other. That is, the effect of the "number of prints for each sheet size," the "number of color prints for sheet size 'W1'," the "number of monochrome prints with process speed 'S'" and the "number of color prints with process speed 'S'" to the X/Y values has the same directivity as the effect of the "accumulated pixel number" to the X/Y values. In other words, the "accumulated pixel number" and the "number of prints for each sheet size," the "number of color prints for sheet size 'W1'," the "number of monochrome prints with process speed 'S'" and the "number of color prints with process speed 'S'" have strong mutual dependence with regard to the effect given to the X/Y values.

On the other hands, it is found that the correlation coefficient M between the "accumulated pixel number" and the "average humidity" is relatively close to "0," which indicates a low correlation with each other. That is, the "average humidity" has strong independence from the "accumulated pixel number" with regard to the effect given to the X/Y values.

Therefore, the present exemplary embodiment employs the correction formula that corrects the average (0.78) of X/Y for each image forming apparatus 3 by use of the "accumulated pixel number" and the "average humidity" of each image forming apparatus 3 affecting the X/Y values independently from each other. The management server 2 thus acquires the "accumulated pixel number information" and the "average humidity information" as well as the "estimate value information on the remaining amount of toner" from each image forming apparatus 3 at the time points (T1, T2 and T3 in FIG. 5) when the remaining amount of toner in each toner container 39 in the image forming apparatuses 3 is assumed to be "75%," "50%" and "25%," respectively.

The following expression (3) represents a correction formula to correct the average $(X/Y)_{ave}$ (for example, 0.78 of FIG. 6) of X/Y for each image forming apparatus 3. In the expression (3), $(X/Y)_m$, P, H, and a and b represent a corrected value of X/Y, the "accumulated pixel number," the "average humidity," and coefficients, respectively.

$$\left(\frac{X}{Y}\right)_m = \frac{b}{a \cdot H + P} \times \left(\frac{X}{Y}\right)_{ave} \quad (3)$$

The correction formula of the expression (3) has, as a basic form, a form in which the average $(X/Y)_{ave}$ of X/Y is divided by the "accumulated pixel number (P)" having the highest correlation with X/Y. Thereby, the correction is made in consideration of the following tendency: in the image forming apparatuses 3, higher "accumulated pixel number (P)" gives lower X/Y (i.e. X/Y decreases from 1), while lower "accumulated pixel number (P)" gives higher X/Y (i.e. X/Y increases toward 1). Additionally, in the expression (3), a correction term of the "average humidity (H)" multiplied by the coefficient a is added to the "accumulated pixel number (P)" in order to take account of the following tendency: higher "average humidity (H)" gives lower X/Y, while lower "average humidity (H)" gives higher X/Y.

That is, when the "accumulated pixel number (P)" affecting the toner consumption is high, the toner consumption becomes higher due to printing and the like of image data having a high image ratio. In such a case, the drive time of the transportation motor 80 per drive becomes longer. Thereby, toner transportation efficiency by the first supply screw 82 and the second supply screw 83 (see FIG. 3) becomes higher, and thereby the amount of the transported toner tends to become higher than the actually predicted value. Therefore, the time (X) when the toner containers 39 are actually replaced tends to become earlier than the predicted value, which gives lower X/Y. On the other hand, when the "accumulated pixel number (P)" is low, the opposite is true. In this way, the "accumulated pixel number (P)," which is a characteristic quantity with regard to variation in toner consumption, is an independent factor that generates dispersion of the average of X/Y.

Additionally, when the "average humidity (H)" is high, the fluidity of toner becomes lower depending on humidity, and thereby the toner tends to move integrally. Thereby, toner transportation efficiency by the first supply screw 82 and the second supply screw 83 driven by the transportation motor 80 becomes higher, and thus the amount of the transported toner becomes higher than the actually predicted value. Therefore, the time (X) when the toner containers 39 are actually replaced tends to become earlier than the predicted value, which gives lower X/Y. On the other hand, when the "average humidity (H)" is low, the opposite is true since the fluidity of toner becomes higher depending on humidity. In this way, the "average humidity (H)," which is a characteristic quantity representing the environment in the image forming apparatus 3, is an independent factor that generates dispersion of the average of X/Y.

Accordingly, the correction formula of the expression (3) is made so that X/Y decreases as the "accumulated pixel number (P)" and the "average humidity (H)" become higher. The correction formula of the expression (3) is set in the correcting unit 24 in the management server 2 according to the present exemplary embodiment, and is used for the correcting unit 24 to correct the "toner empty predicted day" having been predicted by the predicting unit 22. On this occasion, the correcting unit 24 acquires the average $(X/Y)_{ave}$ of X/Y used in the correction formula of the expression (3) from the memory 23. Moreover, the correcting unit 24 acquires the coefficients a and b in the correction formula from the memory 23, in which the coefficients a and b are stored. The calculation method of the coefficients a and b will be described later.

Specifically, the correcting unit 24 acquires information on the "toner empty predicted day" (=Y) from the predicting unit 22, as shown in the following expression (4). The correcting unit 24 then multiplies Y acquired from the predicting unit 22 by $(X/Y)_m$ obtained by use of the expression (3). Thereby, the correcting unit 24 calculates the "corrected toner empty predicted day" (=real_X) that is a closer approximation to the due date (X) on which the actual replacement of the toner containers 39 is required.

$$\text{real_X} = Y \times \left(\frac{X}{Y}\right)_m \tag{4}$$

<Description of Calculation Method of Coefficients Set in Correction Formula>

The coefficients a and b set in the expression (3) are obtained as follows.

First, as in the case of obtaining the histogram shown in FIG. 6, a number of (for example, 100 or more) image forming apparatuses 3 working in the market are used as sampling objects. The management server 2 collects data on the "toner empty predicted day" (Y days) actually predicted by the predicting unit 22 and data on the time (X days) of the actual replacement of the toner containers 39 in response to the "toner empty warning." The management server 2 then calculates the ratio (X/Y) between these data.

Next, the denominator (a·H+P) in the expression (3) is calculated with the "accumulated pixel number (P)" and the "average humidity (H)" for each of the image forming apparatuses 3.

The correlation coefficient between X/Y and (a·H+P) is obtained with X/Y and (a·H+P) of each image forming apparatus 3 by use of the above-mentioned expressions (1) and (2), for example. The coefficient a is then determined by using, for example, a software of typical nonlinear programming so that the absolute value of the obtained correlation coefficient is the closest to "1."

Furthermore, the right-hand side (b/(a·H+P))×0.78 in the expression (3) is calculated with the ratio (X/Y), the "accumulated pixel number (P)" and the "average humidity (H)" for each image forming apparatus 3. The coefficient b is then determined by using, for example, a software of typical nonlinear programming so that either the average or the standard deviation of (b/(a·H+P))×0.78 for each image forming apparatus 3 is the closest to "0."

The coefficients a and b thus determined are stored in the memory 23.

As for the X/Y value, and the coefficients a and b in the correction formula (expression (3)), after the correction formula is first set, those stored in the memory 23 may be updated by the management server 2 performing the above-mentioned process once every one to three months, for example, according to the time of the "estimate value information on the remaining amount of toner" and the "toner empty warning" as well as the "accumulated pixel number information" and the "average humidity information" that the management server 2 acquires from each of the image forming apparatuses 3 connected to the network 4. Thereby, in the correcting unit 24, there is set the correction formula (expression (3)) adjusted to the variation of toner consumption resulted from environmental variation caused by seasonal change, change in a tendency of image types to be printed, and the like. The update of the X/Y value and the coefficients a and b may be performed any time according to the usage status and the like of the image forming apparatuses 3.

<Description of Prediction Process of Remaining Amount of Toner in Image Forming Apparatuses Performed in Management Server>

Next, a description will be described of the prediction process of the remaining amount of toner in the image forming apparatuses 3, which is performed in the management server 2.

Figure 8:
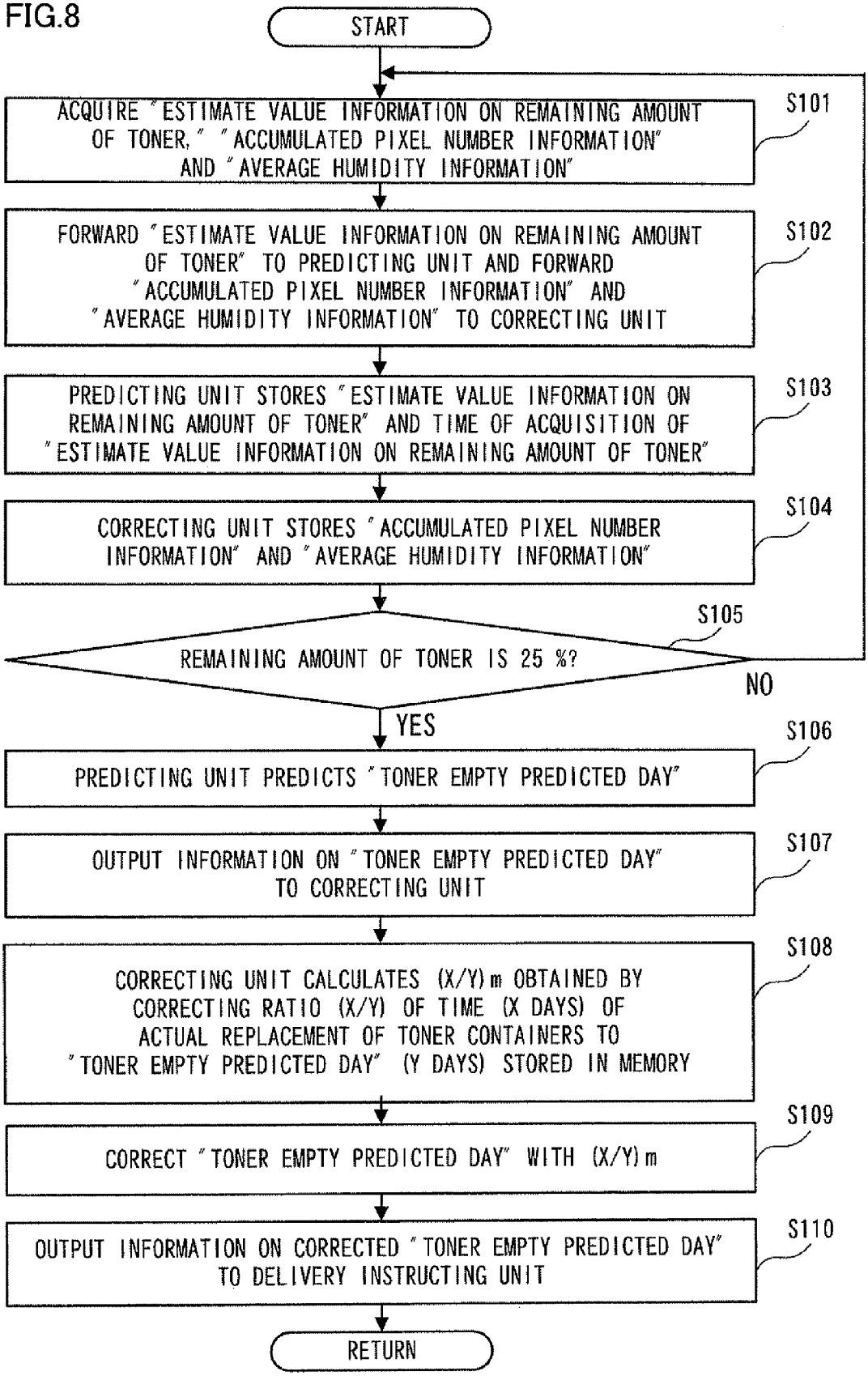
FIG. 8 is a flowchart showing the contents of the prediction process of the remaining amount of toner performed in the management server.

FIG. 8 is a flowchart showing the contents of the prediction process of the remaining amount of toner performed in the management server 2. As shown in FIG. 8, in the management server 2, the communication unit 21 first acquires the "estimate value information on the remaining amount of toner," the "accumulated pixel number information" and the "average humidity information" (Step 101). The communication unit 21 then forwards the acquired "estimate value information on the remaining amount of toner" to the predicting unit 22, and forwards the acquired "accumulated pixel number information" and "average humidity information" to the correcting unit 24 (Step 102). Thereby, the predicting unit 22 stores the "estimate value information on the remaining amount of toner" and the time when the "estimate value information on the remaining amount of toner" is acquired, in the memory (for example, a NVM 104 in FIG. 9 described later) (Step 103). The correcting unit 24 stores the "accumulated pixel number information" and the "average humidity information" in the memory (for example, the NVM 104 in FIG. 9 described later) (Step 104).

The predicting unit 22 then determines whether or not the stored "estimate value information on the remaining amount of toner" indicates that the remaining amount of toner is "25%" (Step 105). If the information is not the "estimate value information on the remaining amount of toner" indicating that the remaining amount of toner is "25%" (No in Step 105), the predicting unit 22 awaits the acquisition of the "estimate value information on the remaining amount of toner" indicating that the remaining amount of toner is "25%."

On the other hand, if the information is the "estimate value information on the remaining amount of toner" indicating that the remaining amount of toner is "25%" (Yes in Step 105), the predicting unit 22 predicts the "toner empty predicted day" with a linear approximation, according to the acquisition time of the "estimate value information on the remaining amount of toner" indicating that the remaining amount of toner is "50%," which has already stored, and the acquisition time and data of the "estimate value information on the remaining amount of toner" indicating that the remaining amount of toner is "25%," which is acquired this time (Step 106). The predicting unit 22 then outputs the information on the predicted "toner empty predicted day" to the correcting unit 24 (Step 107).

When acquiring the information on the "toner empty predicted day" from the predicting unit 22, the correcting unit 24 sets the "accumulated pixel number information (P)" and the "average humidity information (H)" acquired together with the "estimate value information on the remaining amount of toner" indicating that the remaining amount of toner is "25%," to the correction formula (the above-mentioned expression (3)) set in advance. The correcting unit 24 corrects the ratio (X/Y) (correspondence relationship between a predicted value and a measured value) of the time (X days) of the actual replacement of the toner containers 39 to the "toner empty predicted day" (Y days) stored in the memory 23, by use of the correction formula, to calculate the corrected $(X/Y)_m$ (Step 108). The correcting unit 24 further corrects the "toner empty predicted day" acquired from the predicting unit 22, with the corrected $(X/Y)_m$ by use of the above-mentioned expression (4) (Step 109).

The correcting unit 24 then outputs the information on the corrected "toner empty predicted day," namely, the "corrected toner empty predicted day" to the delivery instructing unit 25 (Step 110). Thereby, the delivery instructing unit 25 outputs instructing information to the department in charge (person in charge of delivery) so that the department arranges the delivery of toner (a new toner container 39) to the corresponding image forming apparatus 3.

Incidentally, in the present exemplary embodiment, the correction formula of the expression (3) is provided in terms of the "accumulated pixel number (P)," which is a characteristic quantity with regard to variation in toner consumption, and the "average humidity (H)," which is a characteristic quantity with regard to the toner transportability (characteristic quantity representing the environment in the image forming apparatus 3).

In such a correction formula, any one of the "number of prints for each sheet size," the "number of color prints for sheet size 'W1'," the "number of monochrome prints with process speed 'S'," the "number of color prints with process speed 'S'," as well as a value (what is called "average coverage") obtained by dividing the "accumulated pixel number (P)" by the "number of prints for each sheet size," "frequency of toner supply," "average image density" and the like may be used as the characteristic quantity with regard to variation in toner consumption, instead of the "accumulated pixel number (P)." However, only one characteristic quantity is selected from among these characteristic quantities with regard to variation in toner consumption since these are mutually dependent (see FIG. 7B).

<Description of Internal Configuration of Management Server>

Figure 9:
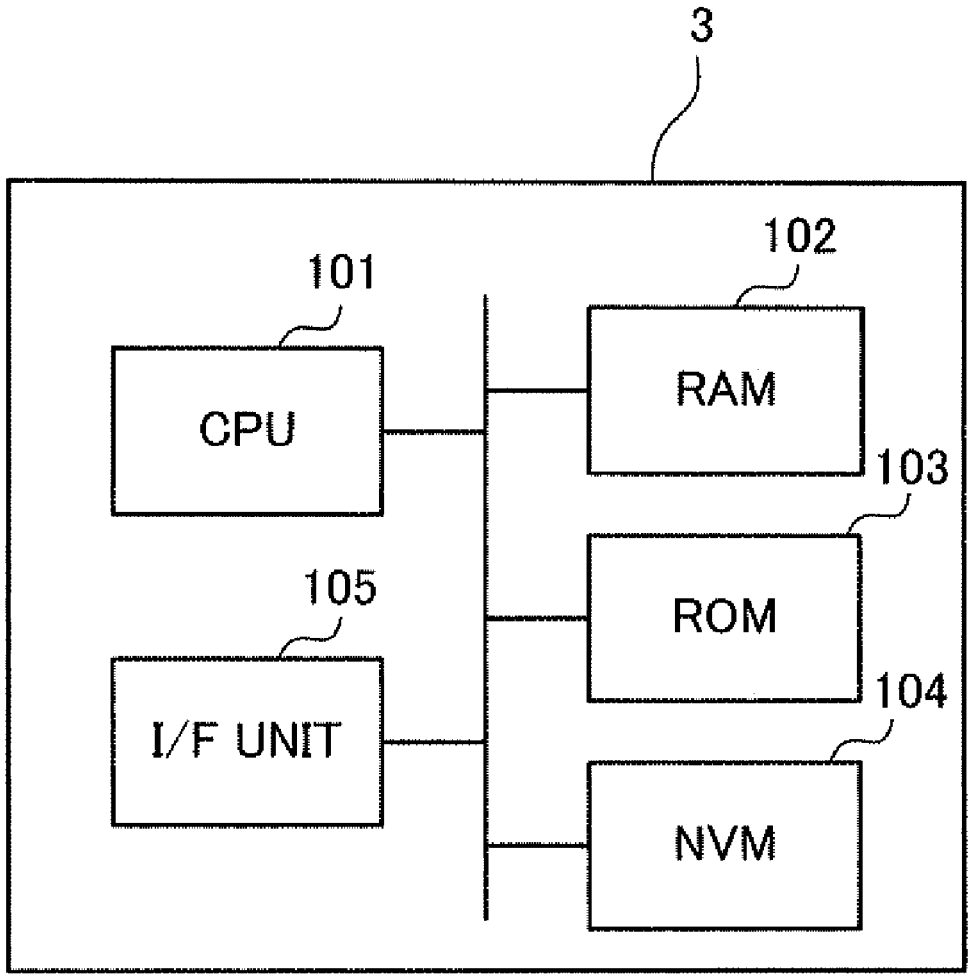
FIG. 9 is a block diagram showing an internal configuration of the management server.

Here, FIG. 9 is a block diagram showing an internal configuration of the management server 2. As shown in FIG. 9, the management server 2 is provided with a CPU 101, a RAM 102, a ROM 103, the non-volatile memory (NVM) 104, and an interface (I/F) unit 105. The CPU 101 executes digital calculation processing in accordance with a processing program set in advance, for the prediction process of the remaining amount of toner in the image forming apparatuses 3. The RAM 102 is used as a working memory or the like for the CPU 101. The ROM 103 stores therein various setting values used in the processing in the CPU 101. The non-volatile memory (NVM) 104, such as a flash memory, is a rewritable, holds data even in a case where the power supply is stopped, and is backed up by a battery. The I/F unit 105 controls an input and an output of signals with each of configuration units in the management server 2.

The CPU 101 reads the processing program from an external storage (not shown) and loads it into a main memory (RAM 102), and achieves a function of each of functional units in the management server 2 (the communication unit 21, the predicting unit 22, the correcting unit 24 and the delivery instructing unit 25).

Note that, as another provision method on this processing program, the program may be provided while being prestored in the ROM 103, and be loaded into the RAM 102. In addition, when an apparatus is provided with a rewritable ROM 103 such as an EEPROM, only this program may be installed in the ROM 103 after the CPU 101 is set, and then may be loaded into the RAM 102. Moreover, this program may also be transmitted through a network such as the Internet and then installed in the ROM 103, and further loaded into the RAM 102. In addition, the program may be loaded into the RAM 102 from an external recording medium such as a DVD-ROM, a flash memory or the like.

As described above, in the management system 1 according to the present exemplary embodiment, for managing the remaining amount of toner in the image forming apparatuses 3, the management server 2 predicts the date when the toner in the toner containers 39 will run out, on the basis of the accumulated toner transportation time during which the toner is transported from the toner containers 39 to the developing devices 33 in each of the image forming apparatuses 3. On this occasion, the management server 2 obtains in advance the ratio (X/Y) of the "toner empty predicted day (Y)" (predicted value) that has been predicted to the time (X) (measured value) of the actual replacement of the toner containers 39. The management server 2 corrects the ratio by use of the "accumulated pixel number (P)," which is a characteristic quantity with regard to variation in toner consumption in each image forming apparatus 3, and the "average humidity (H)," which is a characteristic quantity with regard to the toner transportability (characteristic quantity representing the environment in the image forming apparatus 3). The management server 2 then corrects the "toner empty predicted day (Y)" (predicted value) that has been predicted on the basis of the accumulated toner transportation time, according to the corrected ratio (X/Y).

Thereby, the management server 2 is allowed to improve the prediction accuracy of the time when the remaining amount of toner in the toner containers 39 arranged in the image forming apparatuses 3 will actually run out. Thus, even in an image forming apparatus 3 that has not been used yet and is newly installed in the market, the prediction accuracy of the remaining amount of toner is improved. In addition, updating the X/Y value and the coefficients a and b in the correction formula (above-mentioned expression (3)) regularly at a frequency of about once every one to three months or any time according to the usage status and the like of the image forming apparatuses 3 makes the prediction adjusted to the variation of toner consumption resulted from environmental variation caused by seasonal change, change in a tendency of image types to be printed, and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A management system comprising:

an image forming apparatus including: a developing unit that develops, with toner, an electrostatic latent image formed on an image carrier; a toner storage unit that stores the toner used in the developing unit; and a toner-transporting unit that transports the toner from the toner storage unit to the developing unit; and a management device that is connected to the image forming apparatus through a communication unit, and that manages a remaining amount of toner in the toner storage unit provided in the image forming apparatus, wherein the management device includes:

an acquiring unit that acquires, from the image forming apparatus, information on transportation time of the toner by the toner-transporting unit, information on a characteristic quantity with regard to variation in toner consumption in the developing unit, and information on a characteristic quantity representing environment in the image forming apparatus;

a predicting unit that calculates a predicted value of the remaining amount of toner in the toner storage unit with the information on the transportation time of the toner acquired by the acquiring unit;

a memory that stores a correspondence relationship between the predicted value calculated by the predicting unit and a measured value of the remaining amount of toner in the toner storage unit; and a correcting unit that corrects the correspondence relationship stored in the memory according to the characteristic quantity with regard to variation in toner consumption and the characteristic quantity representing environment, which quantities are indicated by the information acquired by the acquiring unit, and that corrects, with the correspondence relationship having been corrected, the predicted value calculated by the predicting unit, wherein the correspondence relationship between the predicted value calculated by the predicting unit and the measured value of the remaining amount of toner in the toner storage unit is determined as an average of a plurality of X/Y values where:

Y is the actual predicted value, in time, calculated by the predicting unit, and X is a value, in time, from when the toner storage unit was last replaced until the toner storage unit is replaced again in response to a toner empty warning signal.

2. The management system according to claim 1, wherein the correcting unit in the management device corrects the correspondence relationship by use of a correction formula with the characteristic quantity with regard to variation in toner consumption and the characteristic quantity representing environment in the image forming apparatus being variables, while a coefficient set in the correction formula is updated any one of for each period set in advance and any time.

3. The management system according to claim 1, wherein the correspondence relationship stored in the memory in the management device is updated any one of for each period set in advance and any time.

4. The management system according to claim 1, wherein the memory in the management device stores, as the correspondence relationship, an average calculated over a plurality of image forming apparatuses with regard to ratios of predicted values of remaining amounts of toner in a plurality of the toner storage units respectively calculated for the plurality of image forming apparatuses to measured values of the remaining amounts of toner for the plurality of image forming apparatuses for which the predicted values are calculated.

5. The management system according to claim 1, wherein the image forming apparatus further includes: a humidity detecting unit that detects humidity in the image forming apparatus; an average humidity calculation unit that calculates average humidity by weighting a humidity detection value detected by the humidity detecting unit with the number of recording media on which image formation has been performed; and a transmitting unit that transmits, to the management device, information on the average humidity calculated by the average humidity calculation unit as the information on the characteristic quantity representing environment in the image forming apparatus.

6. A management device comprising:

an acquiring unit that acquires information from an image forming apparatus connected to a communication unit and including a developing unit developing with toner an electrostatic latent image formed on an image carrier, a toner storage unit storing the toner used in the developing unit, and a toner-transporting unit transporting the toner from the toner storage unit to the developing unit, the information including information on transportation time of the toner by the toner-transporting unit, information on a characteristic quantity with regard to variation in toner consumption in the developing unit, and information on a characteristic quantity representing environment in the image forming apparatus;

a predicting unit that calculates a predicted value of a remaining amount of toner in the toner storage unit with the information on the transportation time of the toner acquired by the acquiring unit;

a memory that stores a correspondence relationship between the predicted value calculated by the predicting unit and a measured value of the remaining amount of toner in the toner storage unit; and a correcting unit that corrects the correspondence relationship stored in the memory according to the characteristic quantity with regard to variation in toner consumption and the characteristic quantity representing environment, which quantities are indicated by the information acquired by the acquiring unit, and that corrects, with the correspondence relationship having been corrected, the predicted value calculated by the predicting unit, wherein the correspondence relationship between the predicted value calculated by the predicting unit and the measured value of the remaining amount of toner in the toner storage unit is determined as an average of a plurality of X/Y values where:

Y is the actual predicted value, in time, calculated by the predicting unit, and X is a value, in time, from when the toner storage unit was last replaced until the toner storage unit is replaced again in response to a toner empty warning signal.

7. The management device according to claim 6, wherein the correcting unit corrects the correspondence relationship by use of a correction formula with the characteristic quantity with regard to variation in toner consumption and the characteristic quantity representing environment in the image forming apparatus being variables, while a coefficient set in the correction formula is updated any one of for each period set in advance and any time.

8. The management device according to claim 6, wherein the correspondence relationship stored in the memory is updated any one of for each period set in advance and any time.

9. The management device according to claim 6, wherein the memory stores, as the correspondence relationship, an average calculated over a plurality of the image forming apparatuses with regard to ratios of predicted values of remaining amounts of toner in a plurality of the toner storage units respectively calculated for the plurality of image forming apparatuses to measured values of the remaining amounts of toner for the plurality of image forming apparatuses for which the predicted values are calculated.

10. A management method comprising:

acquiring information from an image forming apparatus including a developing unit developing with toner an electrostatic latent image formed on an image carrier, a toner storage unit storing the toner used in the developing unit, and a toner-transporting unit transporting the toner from the toner storage unit to the developing unit, the information including information on transportation time of the toner by the toner-transporting unit, information on a characteristic quantity with regard to variation in toner consumption in the developing unit, and information on a characteristic quantity representing environment in the image forming apparatus;

calculating a predicted value of a remaining amount of toner in the toner storage unit with the information on the transportation time of the toner thus acquired;

acquiring a correspondence relationship from a memory that stores the correspondence relationship between the predicted value and a measured value of the remaining amount of toner in the toner storage unit; and correcting the correspondence relationship acquired from the memory according to the characteristic quantity with regard to variation in toner consumption and the characteristic quantity representing environment, which quantities are indicated by the information thus acquired, and correcting the predicted value with the correspondence relationship having been corrected, wherein the correspondence relationship between the predicted value and the measured value of the remaining amount of toner in the toner storage unit is determined as an average of a plurality of X/Y values where:

Y is the actual predicted value, in time, calculated by the predicting unit, and X is a value, in time, from when the toner storage unit was last replaced until the toner storage unit is replaced again in response to a toner empty warning signal.

11. A non-transitory computer readable medium storing a program that causes a computer to execute a process for prediction of a remaining amount of toner, the process comprising:

acquiring information from an image forming apparatus including a developing unit developing with toner an electrostatic latent image formed on an image carrier, a toner storage unit storing the toner used in the developing unit, and a toner-transporting unit transporting the toner from the toner storage unit to the developing unit, the information including information on transportation time of the toner by the toner-transporting unit, information on a characteristic quantity with regard to variation in toner consumption in the developing unit, and information on a characteristic quantity representing environment in the image forming apparatus;

calculating a predicted value of the remaining amount of toner in the toner storage unit with the information on the transportation time of the toner thus acquired;

acquiring a correspondence relationship from a memory that stores the correspondence relationship between the predicted value and a measured value of the remaining amount of toner in the toner storage unit; and correcting the correspondence relationship acquired from the memory according to the characteristic quantity with regard to variation in toner consumption and the characteristic quantity representing environment, which quantities are indicated by the information thus acquired, and correcting the predicted value with the correspondence relationship having been corrected, wherein the correspondence relationship between the predicted value and the measured value of the remaining amount of toner in the toner storage unit is determined as an average of a plurality of X/Y values where:

Y is the actual predicted value, in time, calculated by the predicting unit, and X is a value, in time, from when the toner storage unit was last replaced until the toner storage unit is replaced again in response to a toner empty warning signal.

12. The non-transitory computer readable medium according to claim 11, wherein the process of correcting the predicted value further includes:

correcting the correspondence relationship by use of a correction formula with the characteristic quantity with regard to variation in toner consumption and the characteristic quantity representing environment in the image forming apparatus being variables; and updating a coefficient set in the correction formula used in the process of correcting the predicted value.

* * * * *